US006079115A

United States Patent [19]

Ringer et al.

[11] Patent Number: 6,079,115

[45] Date of Patent: Jun. 27, 2000

[54] HIGH TEMPERATURE YANKEE HOOD

[75] Inventors: Volker J. Ringer, Chateauguay; George Nowakowski, Montreal, both of Canada

[73] Assignee: Asea Brown Boveri, Inc., LaSalle, Canada

[21] Appl. No.: 09/123,198

[22] Filed: Jul. 27, 1998

[30] Foreign Application Priority Data

Sep. 24, 1997 [CA] Canada ..... 2216591

[51] Int. Cl.[7] ..... F26B 11/02

[52] U.S. Cl. ..... 34/114; 34/121; 34/122

[58] Field of Search ..... 34/425, 444, 446, 34/114, 115, 116, 117, 121, 122, 123; 162/206, 207

[56] References Cited

U.S. PATENT DOCUMENTS

| | | | |
|---|---|---|---|
| 3,163,502 | 12/1964 | Justus et al. | 34/114 |
| 3,167,408 | 1/1965 | Justus et al. | 34/122 |
| 3,377,056 | 4/1968 | Boye | 432/60 |
| 3,793,741 | 2/1974 | Smith, Jr. | 34/549 |
| 3,891,500 | 6/1975 | Kankaanpää | 162/274 |
| 4,064,637 | 12/1977 | Lindgren | 34/122 |
| 4,168,580 | 9/1979 | Weinmann | 34/122 |
| 4,462,169 | 7/1984 | Daane | 34/62 |
| 4,567,673 | 2/1986 | Böhnensieker | 34/392 |
| 4,656,759 | 4/1987 | Yamato | 34/134 |
| 4,743,419 | 5/1988 | Bierschenk | 137/83 |
| 4,942,675 | 7/1990 | Sundovist | 34/421 |
| 5,112,220 | 5/1992 | Wimberger et al. | 432/8 |
| 5,416,979 | 5/1995 | Joiner | 34/114 |
| 5,465,504 | 11/1995 | Joiner | 34/446 |

FOREIGN PATENT DOCUMENTS

| | | |
|---|---|---|
| 677083 | 12/1963 | Canada . |
| 713765 | 7/1965 | Canada . |
| 795026 | 9/1968 | Canada . |
| 2093066 | 10/1993 | Canada . |

*Primary Examiner*—Pamela A. Wilson
*Attorney, Agent, or Firm*—Konneker & Smith, P.C.

[57] ABSTRACT

A Yankee hood is disclosed for use in drying wet paper webs. The Yankee will provide a manufacturer to operate at supply temperatures above 1000° F. at lower total energy costs and at increased production. All major components, supply fans, flow concentrator, air flow equalization plenum and gas burner are consolidated and are mounted directly on the device to eliminate the need for additional space requirements. The hood assembly includes an internal high impingement air system which is supported on a floating structural support member. The nozzle impingement system which incorporates a plurality of nozzle boxes will cover approximately a 240° wrap of a typical Yankee cylinder which will be decoupled from its main support end plate members to allow for increases in cross-machine expansion. The support structure for the externally located direct drive motor is designed to eliminate hood vibrations and operate above the natural building frequency.

1 Claim, 4 Drawing Sheets

HIGH TEMPERATURE YANKEE HOOD

FIELD OF THE INVENTION

This invention relates to paper drying systems and specifically to a Yankee hood using high temperature impingement air to effect the drying.

1. Background of the Invention

Yankee hood systems are used extensively in the manufacture of tissue by the paper industry. Conventionally, the Yankee hood systems have their air processing arrangements located externally of the hood, usually on a mezzanine floor or platform to take advantage of large spaces that are required to install combustion air heaters, circulating fans, their motors and the interconnecting duct work. Such a conventional arrangement would have an air processing system consisting of supply or circulating fans, exhaust fans, combustion chambers and blowers, a burner system and a fuel train all arranged outwardly of the Yankee hood and interconnected with the hood structure through suitable duct work.

Large amounts of capital investment are required to engineer and construct a mezzanine floor, equipment foundations and burner room to enclose air heaters and duct work systems. Similarly, large amounts of capital investment are required also to design and build the necessary external air flow duct work distribution systems. Duct work pressure losses between the apparatus and the hood contributes to additional electrical energy consumed by the circulating fans of the air circulation system and this additional energy constitutes upwards of 15 to 20% of the total electrical energy consumed by these fans. As an example, a medium sized Yankee hood system may consume up to 400 kw/hour.

Moreover, conventional Yankee hood systems normally operate using a maximum supply air temperatures of 1000° F. and require very large external supply and recirculation air systems.

The present invention addresses the shortcomings of the above mentioned conventional hood arrangements that utilize external air heating systems by providing a Yankee hood arrangement which will allow the manufacturer to operate at supply temperatures above 1000° F. at lower total energy costs while at increased production. The hood according to the invention incorporates an integral air heating system and therefore combines the hood with circulating fans, air heaters and air flow duct work distribution systems into a single assembly with the air system apparatus located inside the hood.

2. Prior Art

Canadian Patent 677,083 of Dec. 31, 1963 relates to a method and apparatus for drying a web-like material by supplying a gaseous treatment medium to the web in the form of jets being caused to impinge substantially perpendicularly against the surface of the web. The jets are evenly distributed over the entire surface of the web to be treated and the drying medium is discharged from the web at a number of exhaustion points so that the medium is forced to flow along the web from all directions radially towards the exhaustion points.

Canadian Patent 713,765 of Jul. 20, 1965 discloses a compact unit including a distribution system within the confines of one enclosure.

Canadian Patent 795,026 of Sep. 24, 1968 discloses a compact dryer where the plenum chamber serves simultaneously as a combustion and mixing chamber.

U.S. Pat. No. 5,416,979 of May 23, 1995 discloses a paper web dryer and moisture profiling system where a plurality of gas burners are individually located in each of the nozzle box interiors and are arranged side-by-side along the length of the nozzle box interiors to produce the hot combustion gases for drying.

Other examples of the prior art are to be found in U.S. Pat. Nos. 3,163,502 Dec. 29, 1964; 5,112,220 May 12, 1992; 4,743,419 May 10, 1988; 4,168,580 Sep. 25, 1979, this arrangement showing a drying installation for a paper web including a drying hood having flow channels, heat sources and blowers for circulation of drying medium; U.S. Pat. Nos.4,064,637 Dec. 27, 1977; 3,891,500 Jun. 24, 1975; 4,656,759 Apr. 14, 1987; 4,567,673 Feb. 4,1986; and 4,462,169 Jul. 31, 1984.

While some of the above listed specifications are directed to apparatus for increasing efficiency in web drying processes, they do not disclose the assembly of elements and combination of features found in the present invention.

SUMMARY OF THE INVENTION

Typically, drying costs for a well operated, conventional hood will be fairly low or rise slowly with production increase until the hood is near its capacity limit. At this point, additional drying can only be obtained by reducing the hood's humidity. This rapidly increases the energy cost per ton of paper produced. The present invention will allow the paper manufacturer to operate at supply temperatures above 1000° F. and at lower total energy costs but at increased production. Accordingly, one of the primary advantages of the present invention is that the production capacity limit is much greater and therefore increases production at the same or lower total cost per ton of paper produced.

Additionally, the present invention consolidates all its major components such as specially designed high temperature supply fans, new combustion chamber uniform flow concentrator, air flow equalization plenum and gas burner. This equipment is mounted directly on the drying device thereby eliminating the need for additional space requirement which is usually located behind or on the drive side of a tissue machine. Further energy savings can be realized by reducing thermal and static pressure losses associated with a convention hood and air system.

The hood operation will be extended above 1000° F. with increased paper production potentials.

According to a broad aspect, the invention relates to a Yankee hood assembly for use with drying cylinders in the process of drying wet paper webs, said hood assembly comprising an internally located, high impingement air system including a plurality of nozzle boxes covering approximately a 240° circumferential wrap of a drying cylinder, floating structural members supporting said high impingement system and said air system being decoupled from main support end plate members to accommodate increases in cross-machine expansion. The assembly includes externally located direct drive motor means, support structure for said motor means being so arranged as to eliminate hood vibrations and operate above natural building frequencies.

BRIEF DESCRIPTION OF THE DRAWINGS

The invention is illustrated by way of examples in the accompanying drawings in which.

DETAILED DESCRIPTION OF THE INVENTION

Figure 1:
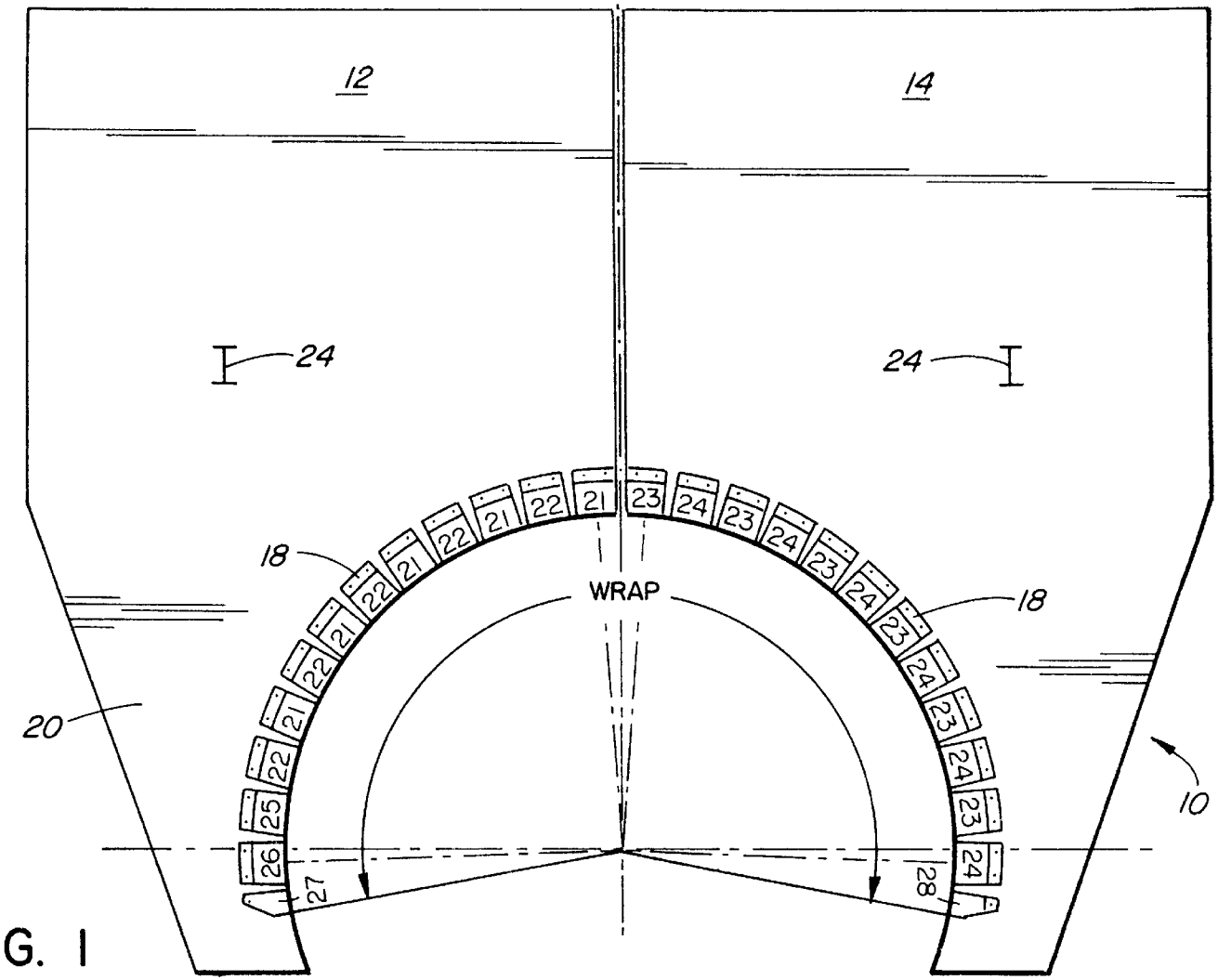
FIG. 1 is an end elevation of a Yankee hood according to the invention.
Figure 2:
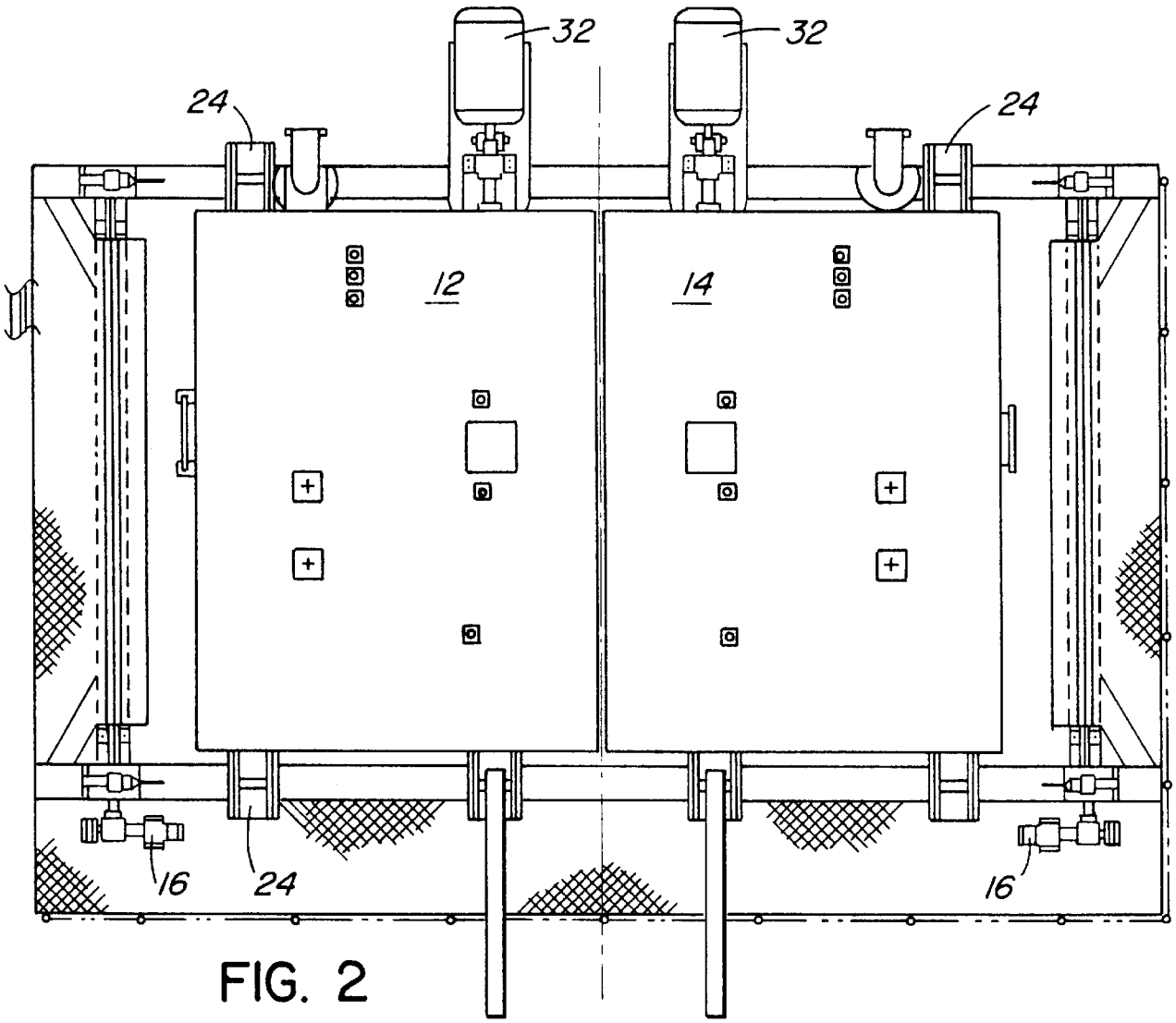
FIG. 2 is a plan view of the hood of FIG. 1.
Figure 3:
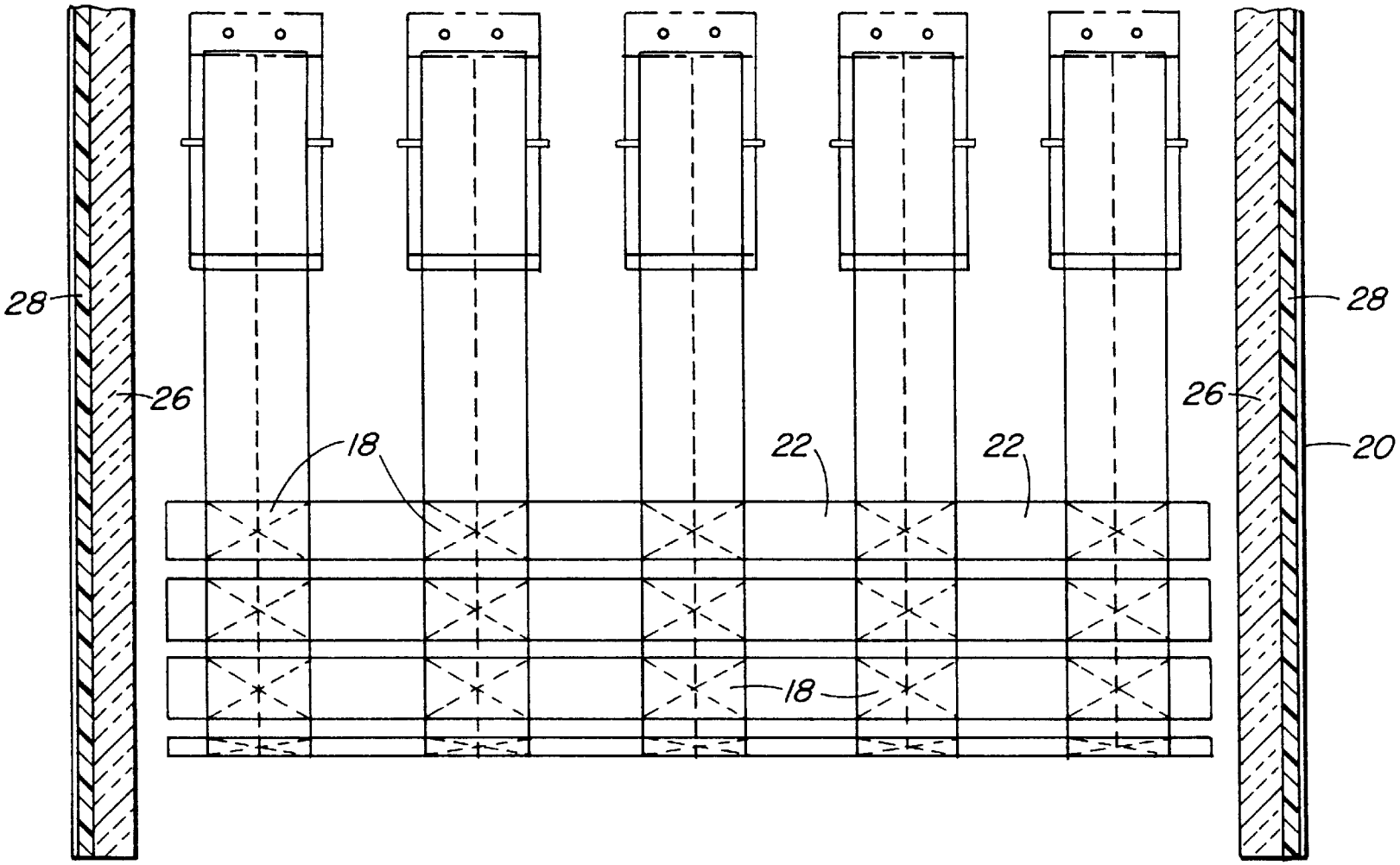
FIG. 3 is a cross-sectional view of the interior of the hood.

Referring to FIG. 1, the hood assembly shown generally at 10 comprises two hood halves 12 and 14 which are movable by suitable motor means 16, FIG. 2, toward and away from one another. In its operative position shown in FIGS. 1 and 2, both halves 12 and 14 of the hood provide a circumferential wrap of approximately 240° around a drying cylinder, not shown. The wrap area accommodates a plurality of nozzle boxes 18 which are decoupled, as shown in FIG. 3, from the main 25 support end plate members 20 of the hood structure. This allows for increased cross-machine expansion which will result from the higher supply air temperatures of the hood according to the invention.

The internally located high impingement air system 22 is supported on floating structural support members 24 as shown in FIGS. 1 and 2 and in order to eliminate structural deformation of the main Yankee hood end plate structures 20, all of the internal hood services are insulated with high temperature ceramic insulation 26 and a vapour barrier 28 including weep holes is located intermediate the insulation 26 and the end plates support structures 20 in order to inhibit vapour penetration.

Figure 4:
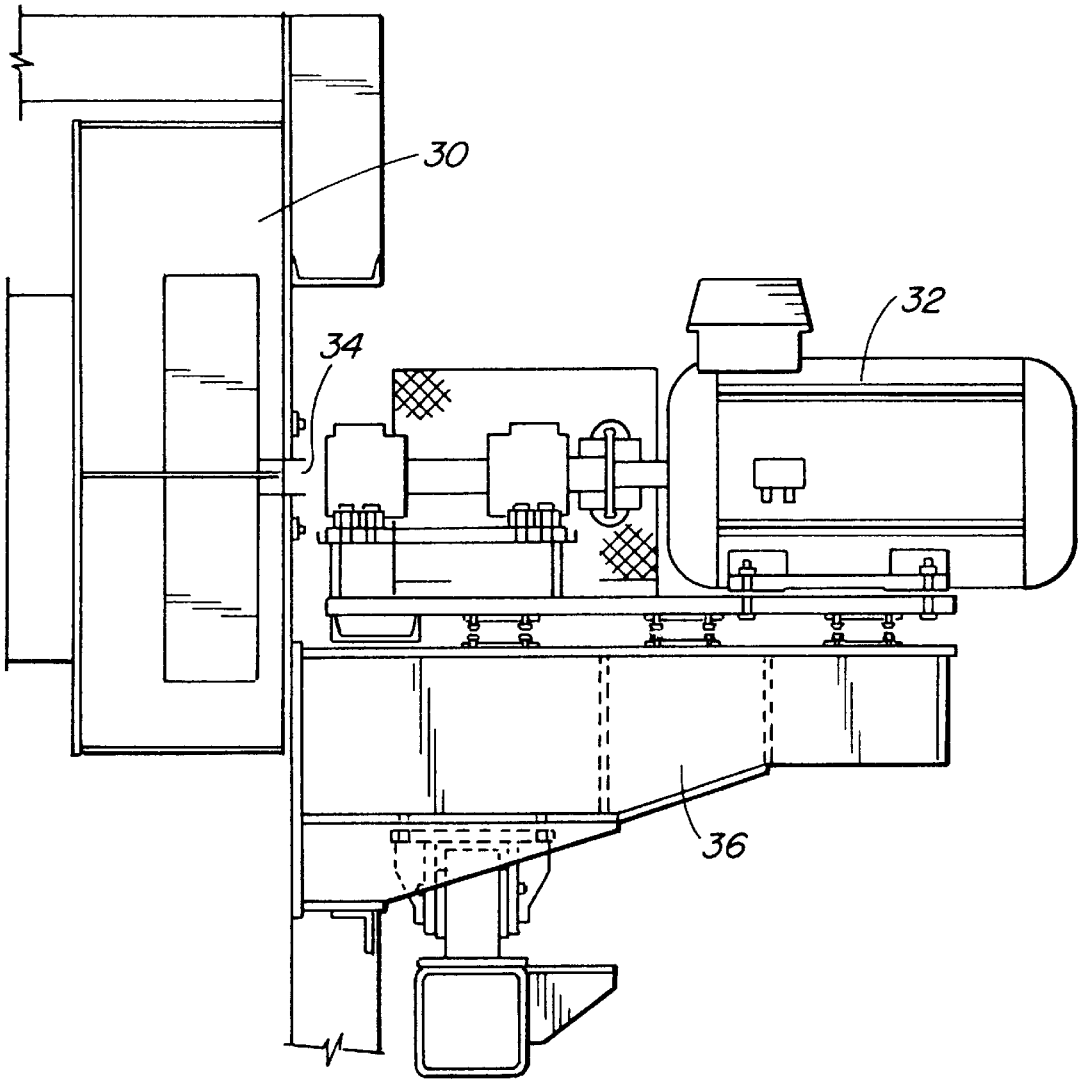
FIG. 4 is an elevation view of the support structure for the fan drive of the hood.

As shown in FIGS. 2 and 4, the hood incorporates high temperature supply fans 30 which are driven by externally located supply motors 32 by means of suitably coupled drive shafts 34. The support structure 36 for the drive motors 32 is designed to eliminate hood vibrations and operate above the natural building frequencies.

All of the internal Yankee hood components are fabricated of special high temperature alloys in order to eliminate stress and fatigue cracking which is commonly experienced with conventional Yankee hoods.

It will be appreciated that a Yankee hood constructed in accordance with this invention will provide a paper manufacturer with means to operate at supply temperatures above 1000° F. to result in increased paper production potentials with a noticeable reduction of thermal losses and static pressures.

While the invention has been described in connection with a specific embodiment thereof and in a specific use, various modifications thereof will occur to those skilled in the art without departing from the spirit and scope of the invention as set forth in the appended claims.

The terms and expressions which have been employed in this specification are used as terms of description and not of limitations, and there is no intention in the use of such terms and expressions to exclude any equivalents of the features shown and described or portions thereof, but it is recognized that various modifications are possible within the scope of the invention claims.

The embodiments of the invention in which an exclusive property or privilege is claimed are defined as follows:

1. A Yankee hood assembly for use with drying cylinders in the process of drying wet paper webs, said hood assembly having:

a pair of hood halves movable toward and away from one another;

motor means to effect said movement of said hood halves, said hood halves, together, incorporating an internally located, high impingement air distribution system, said system including a plurality of nozzle boxes covering approximately a 240 degree circumferential wrap about a drying cylinder;

floating structural support members extending through said hood halves in a transverse, cross-machine direction, said high impingement air system being supported on said floating members; and main support end plate members forming part of said hood assembly, said high impingement air distribution system being decoupled from said main support end plate members to accommodate increases in cross-machine machine expansion of said air distribution system, said hood assembly including associated, direct drive motor means and support means therefor.

* * * * *

UNITED STATES PATENT AND TRADEMARK OFFICE

CERTIFICATE OF CORRECTION

PATENT NO. : 6,079,115
DATED : June 27, 2000
INVENTOR(S) : Ringer et al.

It is certified that error appears in the above-identified patent and that said Letters Patent is hereby corrected as shown below:

Column 4,
Line 40, insert -- fan -- after "drive".
Line 41, delete "therefor" insert -- for said direct drive motor means -- in place thereof.

Signed and Sealed this

Twenty-eighth Day of August, 2001

*Attest:*

Nicholas P. Godici

NICHOLAS P. GODICI
*Acting Director of the United States Patent and Trademark Office*

*Attesting Officer*